United States Patent [19]

Sengewald

[11] Patent Number: 4,721,396

[45] Date of Patent: Jan. 26, 1988

[54] BAG AND METHOD OF MANUFACTURING THE SAME

[76] Inventor: Karl-Heinz Sengewald, Kreisstrasse 16, 4802 Halle in Westfalen 1, Fed. Rep. of Germany

[21] Appl. No.: 833,986

[22] Filed: Feb. 26, 1986

[30] Foreign Application Priority Data

Mar. 7, 1985 [DE] Fed. Rep. of Germany ..... 3508123

[51] Int. Cl.[4] ..... B65D 33/10

[52] U.S. Cl. ..... 383/8; 383/27; 383/120; 229/DIG. 6

[58] Field of Search ..... 383/8, 7, 9, 24, 27, 383/115, 122, 126, 2, 120; 229/52 A, DIG. 6

[56] References Cited

U.S. PATENT DOCUMENTS

| | | | |
|---|---|---|---|
| 3,352,214 | 11/1967 | McColgan | 383/122 |
| 3,380,646 | 4/1968 | Doyen et al. | 383/122 |
| 3,580,486 | 5/1971 | Kugler | 383/120 |
| 3,646,723 | 3/1972 | Meroney | 383/9 |
| 4,573,203 | 2/1986 | Peppiatt | 383/8 |
| 4,597,103 | 6/1986 | Hoover | 383/8 |

FOREIGN PATENT DOCUMENTS

| | | | |
|---|---|---|---|
| 964825 | 7/1964 | United Kingdom | 383/8 |
| 1259473 | 1/1972 | United Kingdom | 383/7 |
| 3321341 | 6/1983 | Fed. Rep. of Germany . | |

*Primary Examiner*—Willis Little

*Attorney, Agent, or Firm*—Michael J. Striker

[57] ABSTRACT

A bag for fluidic commodities is formed of a hose of thermoplastic film material and includes a body having side folds and formed by two opposing walls welded to each other at at least their upper ends. The bag has a filling opening and a loop-shaped gripping handle formed by two opposite strips cut out from the blank of the bag and welded to each other at the upper ends. A method of producing such bags includes steps for making the bag body and the gripping handle.

14 Claims, 17 Drawing Figures

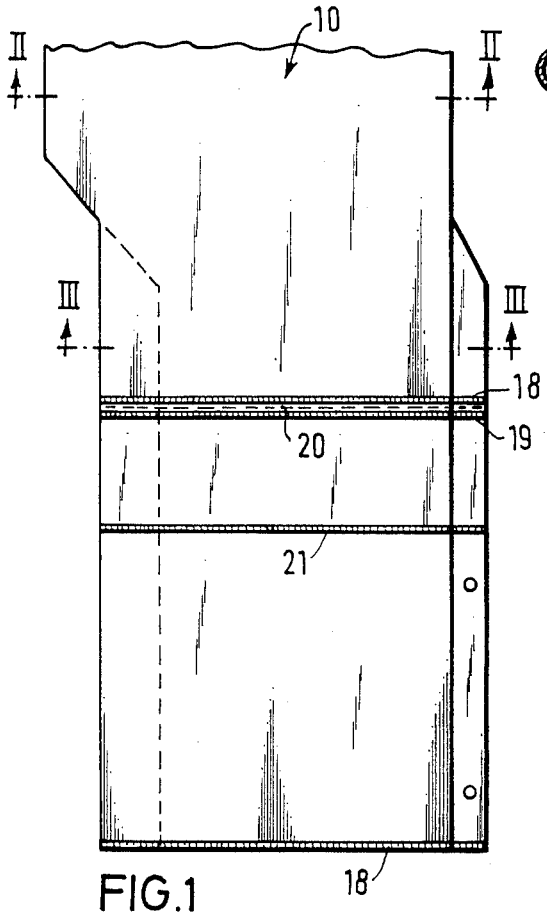
FIG.1
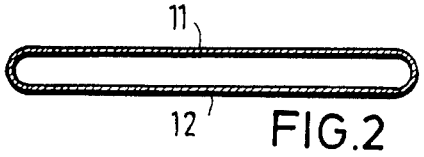
FIG.2
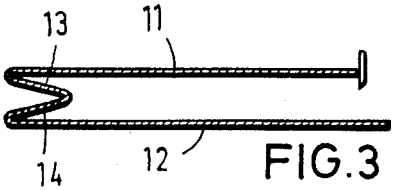
FIG.3
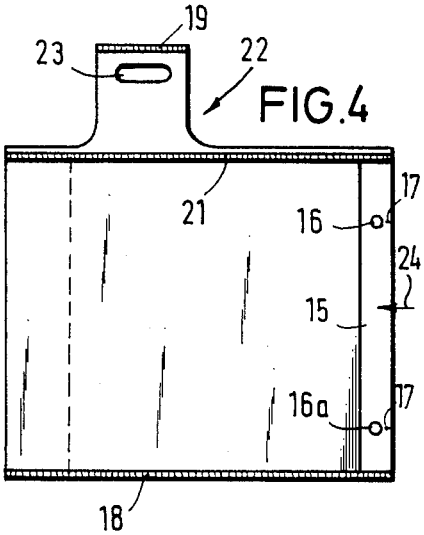
FIG.4
FIG.5
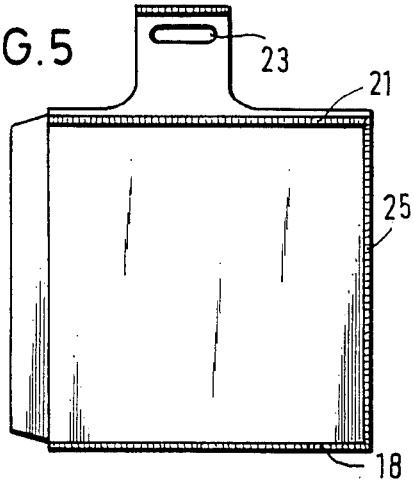
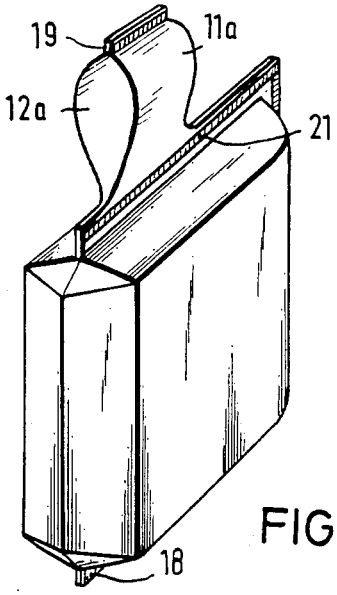
FIG.6

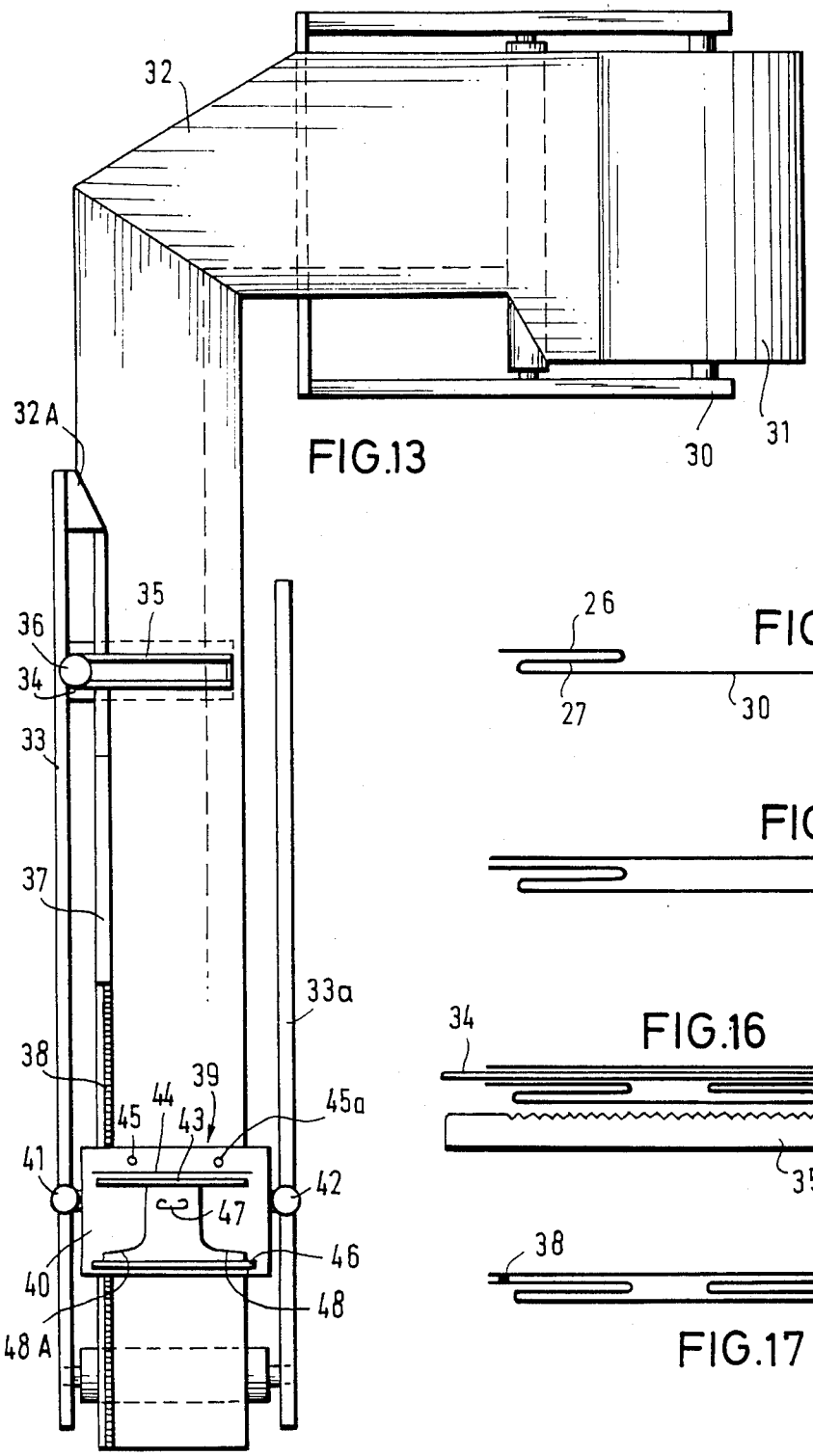
FIG.13
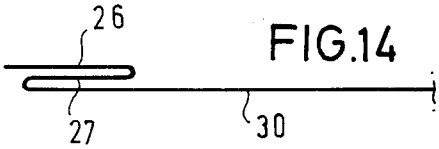
FIG.14
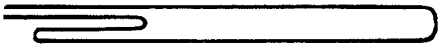
FIG.15
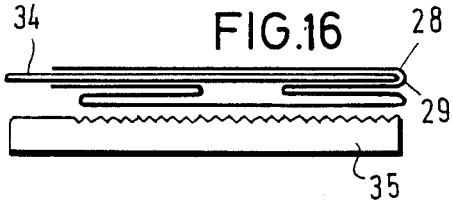
FIG.16
FIG.17

BAG AND METHOD OF MANUFACTURING THE SAME

BACKGROUND OF THE INVENTION

The present invention relates to packing means in general, and more particularly to a bag of heat sealed or thermoplastic film and a method of manufacturing of such bags.

Packages or bags of the type under consideration have been produced from a hose or a half-hose of thermoplastic film and provided with a grip in the form of a grip hose. These bags have been made of various shapes depending on the application of such bags.

Bags produced of heat-sealed plastic film have been disclosed in applicant's pending U.S. applications Ser. No. 471,140; 664,887; 540,606 and 678,010.

A plastic bag with a loop-shaped grip has been disclosed in DE-OS 33 21341. This disclosed plastic bag has folds, such as head folds, by means of which a filling volume of the bag is enhanced. The grip of the bag is formed as a hose projecting beyond the two opposite walls of the bag. Because of an increased, filling volume there is, however a danger that the package, depending on a commodity with which it is to be filled, would be loaded too much. Since the loading is transmitted to the gripping hose it has been proposed, for example in DE-OS 33 21 341 that the grip would be made as a loop of a plastic film material and be provided at each end of the grip with a strip formed in one piece with the grip and of the length which would substantially correspond to the width of the bag, each strip being connected to the walls of the bag by welding.

The provision of the bag with strips and also the necessity of making additional welding seams to connect the strips to the walls of the bag make the manufacturing of such bags rather expensive.

SUMMARY OF THE INVENTION

It is an object of the present invention to provide an improved bag and method of manufacturing of such bags.

It is another object of the present invention to provide a bag or package with a loop-like grip which would be adapted for greater filling volumes and whose production would be simple and inexpensive.

These and other objects of the invention are attained by a method of manufacturing bags or the like packages of thermoplastic film and including a bag body made of an elongated hose or a half-hose, and a loop-shaped gripping handle connected to said body, the method comprising the steps of producing side folds in said hose; making a first weld seam on said hose in the direction transversal to the elongation of said hose and a separation perforated cut closely adjacent to said weld seam also in said transversal direction to separate a single bag from the hose; providing a second weld seam also in said transversal direction and at a distance from said first weld seam, corresponding to the height of said gripping handle, so as to connect two opposite walls of the bag being produced to each other; and making lateral cuts in the region between said first weld seam and said second weld seam in both walls of the bag so as to obtain said loop-shaped gripping handle.

The method according to the invention offers a very simple fashion of manufacturing of the bags with large filling volumes and with strong gripping handles which can be adjusted in length to various requirements of the bag, namely its size and filling volume.

According to one modified embodiment the second weld seam may be formed by impulse welding.

One side longitudinal edge of the bag between said walls may remain open and then two first weld seams may be applied to said bag at a small distance from each other in said transversal direction, and said separation perforated cut is provided between said two first weld seams.

The method according to the invention may further comprise the step of making two suspension holes for holding pins, said holes extending in one row and being produced before said second weld seam is applied to the bag.

The objects of the present invention are also attained by a packing bag of thermoplastic film material, comprising a bag body having two opposing walls connected to each other at two opposite ends by weld seams, and formed with side folds; and a gripping handle, said walls being film layers connected to each other by an upper weld seam and a lower weld seam spaced from said upper weld seam by a distance corresponding to the height of the bag, said body having at an edge of the bag opposite to said side folds a filling opening, one of said walls having a flap portion protruding laterally outwardly of said body and provided at said filling opening, said flap portion having two suspension openings, said gripping handle being formed by two opposing strips connected to each other by a weld seam which is parallel to said upper weld seam so that said gripping handle is loop-shaped.

In a modified embodiment, a packing bag of thermoplastic film material may comprise a bag body having two opposing walls connected to each other by weld seams, and formed with side folds at both sides thereof; and a gripping handle, said walls being film layers connected to each other by an upper weld seam, said body having at a distance from said upper weld seam, corresponding to the height of the bag a filling opening, one of said walls having in the region of said filling opening two suspension openings, said gripping handle being formed by two opposing strips connected to each other by a weld seam which is parallel to said upper weld seam so that said gripping handle is loop-shaped.

The opposite strips may merge into said opposing walls with a large curve radius.

The gripping handle may be laterally offset from the middle of the bag or alternatively, arranged in the middle of the bag.

Stamped recesses may be formed in said both strips.

The bags of the present invention are produced from a hose or half hose unwound from a roll of film and running through a frame provided with cutters and welding devices.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a top plan view of the blank for making a bag according to the invention;

FIG. 2 is a sectional view of the hose of FIG. 1, taken on line II—II of FIG. 1;

FIG. 3 is a sectional view through the half of the hose, taken along line III—III of FIG. 1;

FIG. 4 is a side view of a finished bag:

FIG. 5 is a side view of the filled bag;

FIG. 6 is a perspective view of the filled bag of FIG. 5;

FIG. 13 is a schematic top plan view of the device for producing bags of FIG. 11; and FIGS. 14 through 17 illustrate the steps of forming a hose with side folds.

DETAILED DESCRIPTION OF THE PREFERRED EMBODIMENTS

Figure 7:
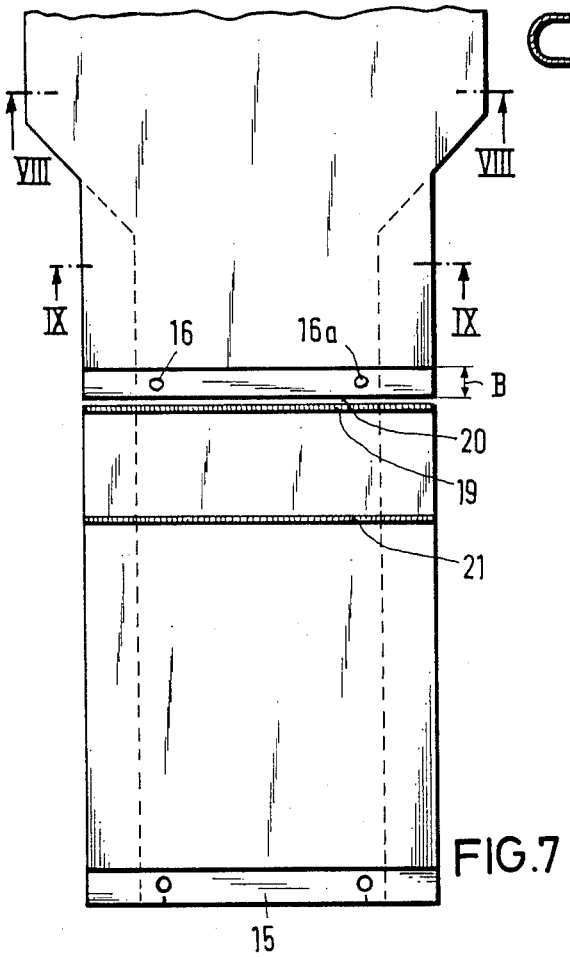
FIG. 7 is a top plan view of the blank of the bag of a modified embodiment.

Referring now to the drawings in detail, and firstly to FIGS. 1 and 2 thereof, these figures illustrate a hose 10 of thermoplastic film, which hose has an upper layer or wall 11 and a lower layer or wall 12. Side folds 13 and 14 are formed at the longitudinal edges of the elongated hose whereas the opposite longitudinal edge is cut off so that the lower wall 12 is spaced from and is positioned against the upper wall 11, and a flap 15 is formed in which two suspensions openings 16, 16*a* are provided in the known manner. A filling opening is provided at the flap 15 so as to facilitate a later filling of the bag. Cutouts 17, 17*a* correspond to openings 16 and 16*a*. These cutouts serve the purpose of facilitating a separation of the bag from holding pins.

After the formation of the side folds 13 and 14 and cutting off the edge of the hose to form the flap 15 two cuts 18 and 19, one closely after the other, and with a separating perforation 20 therebetween, are made for producing the bags and separating the same from the hose. A separation seam can be made by welding by means of a weld beam. Two adjacent weld surfaces and a separating cut positioned therebetween can be produced. A welding wedge can be utilized to connect walls 11 and 12 to each other and simultaneously produce a separating cut. The separating cut can be formed by perforation as shown in FIG. 1. An impulse-weld seam is applied to the hose at the distance from the perforation 20. This impulse weld seam connects the layers or walls 11 and 12 to each other and also defines the location of the gripping handle produced later.

After the production of the bag, cuts are made in the region between the weld seam 19 and weld seam 21 at the right-hand side and the left-hand side so that a loop-like grip 22 is formed also from the film layers 12 and 12. The grip 22 is comprised of two opposing rather wide strips 11*a* and 12*a* which are connected to each other at the upper sides with a weld seam 19 and at the lower sides with the impulse weld seam 21.

A gripping stamping-out or recess 23 can be provided in both strips 11*a* and 12*a*. A bag is normally carried out at the gripping recess 23.

As shown in FIG. 6 a gripping handle can be formed by a part of the hose 12*a*, 11*a* and a human hand can be inserted into the loop-shaped gripping handle. Finally it is also possible to make the grip handle of such a length that a person would be able to stretch the arm into the lateral opening in the gripping handle (FIG. 6).

The solution as to which gripping handle to choose depends on the fact that the handle should be adjusted to loads applied to the bag so it is possible, by the formation of a stamping cut, to make wider or narrower gripping strips 11*a* and 12*a*. It is also possible to change the distance between the weld seams 18, 19 and 21 so as to change the height of the gripping loop.

The formation of the gripping handle will result from continual manufacturing of individual bags. In many instances it is expedient to make a plurality, for example 30 bags as shown in FIG. 1, to stack them and to stamp-out recesses 23 to form the gripping handles.

FIG. 4 illustrates the gripping hose extended in the direction of elongation of the bag or the hose which is a blank for the bag being produced. The gripping hose in the embodiment of FIG. 4 is offset from the middle to the left. With the filled bag, however, a substantially middle position of the gripping loop is possible because the side folds 13 and 13 are no longer in the folded position shown in FIG. 3 but these folds extend outwardly so that the handle formed by strips 11*a*, 12*a* appears in the middle.

After filling the bag through a filling opening in the direction of arrow 24 in FIG. 4, a longitudinal weld seam 25 is provided as shown in FIG. 5. The flap 15 is removed thereby.

Figure 8:
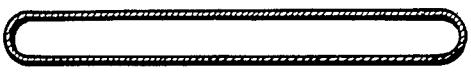
FIG. 8 is a vertical sectional view of the hose of FIG. 7, taken on line VIII—VIII of FIG. 7.
Figure 9:
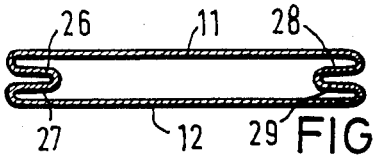
FIG. 9 is a vertical sectional view of the hose, taken along line IV—IX of FIG. 7.
Figure 11:
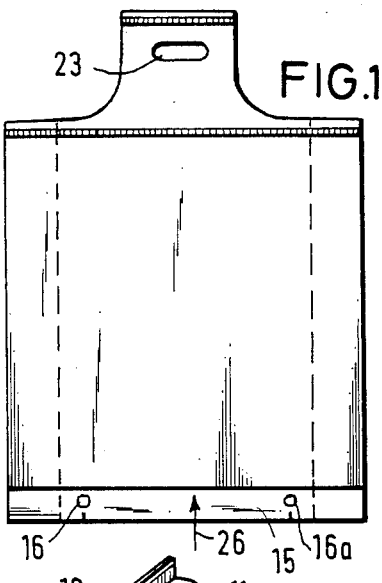
FIG. 11 is a side view of the finished bag.

In the modified embodiment shown in FIGS. 7 through 12 a hose is first formed as shown in FIG. 8. This hose can be formed of a flat bedway. Side folds 26, 27 and 28, 29 are formed at two opposing longitudinal edges of the hose. This is obtained by the device which is illustrated in FIGS. 13 and 16. Cuts are made in the upper film layer 11 and at the side folds 26, 27 and 28, 29 at the distance B (FIG. 7) from each other. At the same time, flap 15 extended beyond the bag is provided by a cut in the upper layer. Flap 15 has suspension openings 16, 16*a* for holding pins. Thereafter or simultaneously, individual transverse weld seam 19 for connecting the film layers 11 and 12 to each other and a cut 20 for separating the bag from the elongated hose are produced in the bag, depending on the direction of its movement in the machine. In the same manner as that described for FIG. 8, an impulse weld seam 21 is provided at the distance from the weld seam 19 and at the height of the gripping hose. Then stampings are formed in the region between the transverse weld seams 19 and 21 to make the gripping hose with walls 11*a* and 12*a* in the same manner as described for FIGS. 1 through 6. Perforation or cut 20 is provided to separate the individual bag from the roll.

Figure 10:
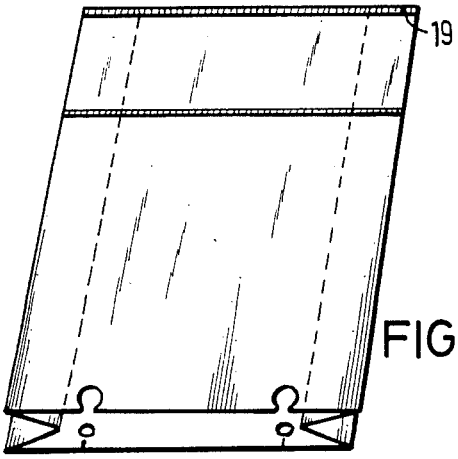
FIG. 10 is a perspective view of yet unfinished bag.

FIG. 10 shows that in this embodiment the filling opening is provided at the flap 15 at the lower edge of the bag. Openings in the upper layer of the bag are of greater diameter, these openings reaching the front edge and do not prevent drawing off the bag.

Figure 12:
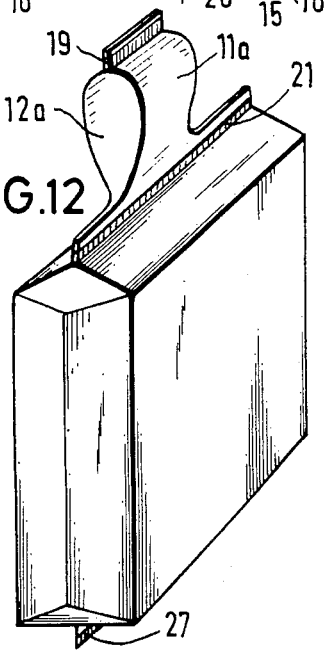
FIG. 12 is a perspective view of the bag of FIG. 11 but in a filled condition.

After the bag has been filled with a solution or the like in the direction of arrow 26 a transverse weld seam 27 is provided on the bag, as shown in FIG. 12. The bag of the embodiment shown in FIG. 1 is adapted to greater volumes as compared to that of FIGS. 1 to 6 because the side folds are provided at both longitudinal sides of the bag.

FIGS. 13 through 17 illustrate the device for making bags of FIG. 12. FIG. 13 shows a feeding or unwinding block 30 with a supply roll 31 of flat bedway. Side folds 28, 29 are produced at this stage. Then the film is fed via a folded triangle 32 for the formation of the hose. Finally, via a format sheet 32A, which is secured to the machine frame mails 33, 33*a*, side folds 26, 27 are made. A counter-cutting device 34 is connected to the machine frame 33. A U-shaped cutter 35 is supported on the machine frame 33. This cutter is reciprocally movable by means of a piston-cylinder device 36, as shown in FIG. 7, so as to cut the strips extending transversally to the hose at the distance B in the upper film layer and also in the side folds 26, 27 and 28, 29. As seen from FIG. 16 the cutter 35 acts from below so that the cut-off portions could be easily removed. This however does not affect the above-described system.

An elongated weld seam 38 is produced on the bag being made by a welding device 37. A welding and separating device 39 has various functions. This device includes a plate 40 movable up and down by means of piston-cylinder arrangements 41 and 42. A transversal welding beam 43 with a cutter 44 for producing the weld seam 19 and the separating cut 20 shown in FIG. 7, is provided on the plate 40. At the same time, two punching pins 45 and 45*a* are provided on the plate 40 for making suspension holes 16 and 16*a* in the bag.

A transversal welding beam 16 for producing an impulse weld seam 21 shown in FIG. 7 is mounted to the plate 40 at the distance from the weld beam 43, corresponding to the height of the gripping hose. Plate 40 also carries a hole-stamping device 47 for producing gripping holes or recesses 21. Curved cutters 48 and 48A for making cuts at the sides of the gripping loop are further supported on the plate 40.

It is to be noted that the welding beams and welding devices mounted on the supporting plate 40 at the distance from each other can be easily adjusted relative to each other and are easily exchangeable in order to obtain gripping hoses in dependence on the loading of the bag or other package being produced.

It is to be understood that the perforation cut can be also made by the transversely running cutter so as to further unwind the bag from the roll. The holes for the supporting pins shown in FIG. 10 can be also made by this device.

The bag of the present invention has the capacity to hold large volumes the gripping hose of which can be adjusted to various sizes and shapes of the product packed in the bag.

It will be understood that each of the elements described above, or two or more together, may also find a useful application in other types of bags and methods for making the same differing from the types described above.

While the invention has been illustrated and described as embodied in a bag and a method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of manufacturing bags or the like packages of thermoplastic film and including a bag body made of an elongated hose or a half-hose and having an opening which is closed after filling the bag body, and only one loop-shaped griping handle connected to said body, the method comprising the steps of producing side folds in said hose; making a first weld seam on said hose in the direction transversal to the elongation of said hose and a separation cut closely adjacent to said first weld seam, also in said transversal direction to separate a single bag from the hose; providing a second weld seam also in said transversal direction and at a distance from said first weld seam, corresponding to the height of said gripping handle, so as to connect two opposite walls of the bag being produced to each other; and making a lateral cut in the region between sid first weld seam and said second weld seam in both walls of the bag at each side of the bag as considered in said transversal direction, so as to obtain said only one loop-shaped gripping handle.

2. The method as defined in claim 1, wherein one side longitudinal edge of the bag between said walls remains open to form said opening, while the opposite side longitudinal edge is formed with side folds.

3. The method as defined in claim 1, further comprising the step of making two suspension holes for holding pins, said holes extending in one row and being produced before said second weld seam is applied to the bag.

4. A method as defined in claim 1; and further comprising the step of providing filling opening at one side longitudinal edge of the elongated hose or half-hose, said step of producing side folds in said hose including producing side folds and other side longitudinal edge of the hose, said step of making first weld seam including forming two such first weld seams at a small distance from each other and said separation cut between said two first weld seam, said step of making a lateral cut at each side of bag including a retaining said second weld seam and said separation cut in said only one loop-shaped gripping handle.

5. A packing bag of thermoplastic film material, comprising a bag body having two opposing walls connected to each other at two opposite ends by weld seams, and formed with side folds; and a gripping handle, said walls being film layers connected to each other by an upper weld seam and a lower weld seam spaced from said upper weld seam by a distance corresponding to the height of the bag, said body having at an edge of the bag opposite to said side folds a filling opening, one of said walls having a flap portion protruding laterally outwardly of said body and provided at said filling opening, said gripping handle being formed by two opposing strips connected to each other by a weld seam which is parallel to said upper weld seam so that said gripping handle is loop-shaped.

6. A packing bag as defined in claim 5, wherein said flap portion is formed so that the bag can be held by said flap portion during filling of the bag.

7. A packing bag as defined in claim 6, wherein said flap portion has two suspension openings.

8. The bag as defined in claim 5, wherein said opposite strips merge into said opposing walls with a large curve radius.

9. The bag as defined in claim 5, wherein said gripping handle is laterally offset from the middle of the bag.

10. The bag as defined in claim 5, wherein stamped recesses are formed in said both strips.

11. A packing bag of thermoplastic film material, comprising a bag body having two opposing walls connected to each other by weld seams, and formed with side folds at both sides thereof; and only one gripping handle, said walls being film layers connected to each other by an upper weld seam, said body having at a distance from said upper weld seam, corresponding to the height of the bag a filling opening, one of said walls having in the region of said filling opening two suspension openings, said only one gripping handle being formed by two opposing strips connected to each other by a weld seam which is parallel to said upper weld seam so that said only one gripping handle is loop-shaped.

12. The bag as defined in claim 11, wherein said opposite strips merge into said opposing walls with a large curve radius.

13. The bag as defined in claim 11, wherein said gripping handle is arranged centrally of the bag.

14. The bag as defined in claim 11, wherein stamped recesses are formed in said both strips.

* * * * *